United States Patent [19]

Lemmer

[11] 4,337,447

[45] Jun. 29, 1982

[54] SWITCH

[75] Inventor: Helmut Lemmer, Marienheide, Fed. Rep. of Germany

[73] Assignee: Starkstrom Gummersbach GmbH, Marienheide, Fed. Rep. of Germany

[21] Appl. No.: 242,853

[22] Filed: Mar. 12, 1981

[30] Foreign Application Priority Data

Mar. 13, 1980 [EP] European Pat. Off. ..... 80 101 314.5

[51] Int. Cl.[3] ..... H01H 9/20

[52] U.S. Cl. ..... 335/167; 335/202

[58] Field of Search ..... 335/6, 132, 133, 167, 335/202, 278

[56] References Cited

U.S. PATENT DOCUMENTS 3,808,567 4/1974 Maier ..... 335/167

3,852,544 12/1974 Grunert et al. ..... 335/167

*Primary Examiner*—George Harris

*Attorney, Agent, or Firm*—Allison C. Collard; Thomas M. Galgano

[57] ABSTRACT

In a switch, in particular a power, control or starter switch, a contact system and a magnetic system are provided in a housing whereby the magnetic system actuates the contact system. The contact system is provided with contact bars having rigid contact pieces, as well as actuable bridges with movable contact pieces which are actuated by means of a common bridge, whereby each bridge and the associated contact bars are mounted in a switch chamber. Furthermore, a switch-on contact with a self-locking contact is provided. In switches of this type, it is typically required to hold a switching operation for a longer time period, without necessitating the manually pushing down of a push key. The required separate switch-on contact is typically mounted in a separate large housing. In order to reduce the structural and space requirements and to permit a simple wiring, a contact yoke is structurally integrated with the switch for the switch-on contact which can be actuated from the outside by means of an actuating element and which cooperates with the common bridge support.

11 Claims, 15 Drawing Figures

FIG. 2
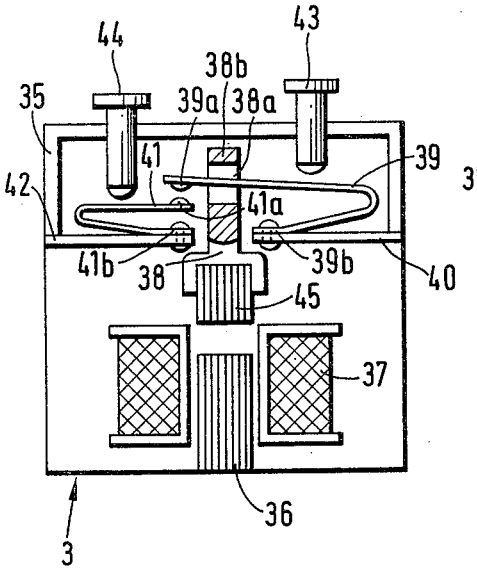
FIG. 3
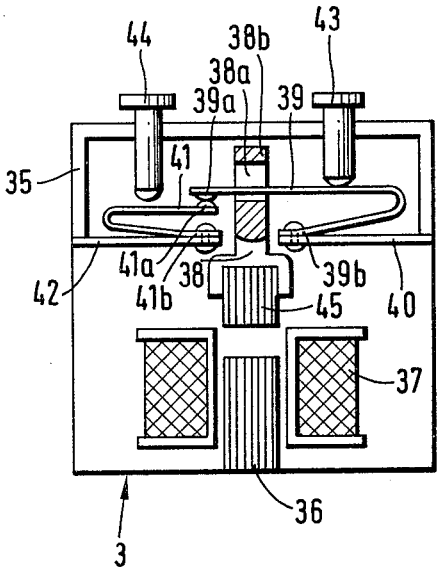
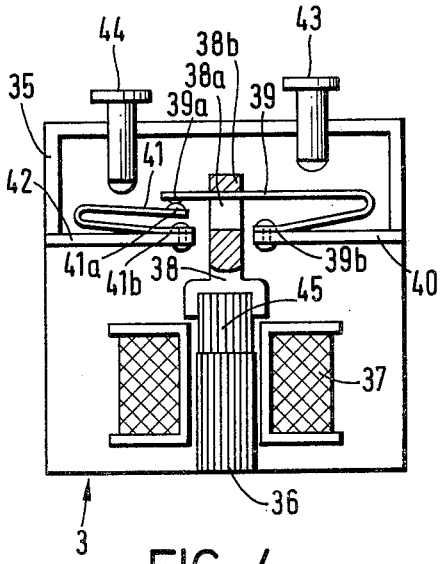
FIG. 4
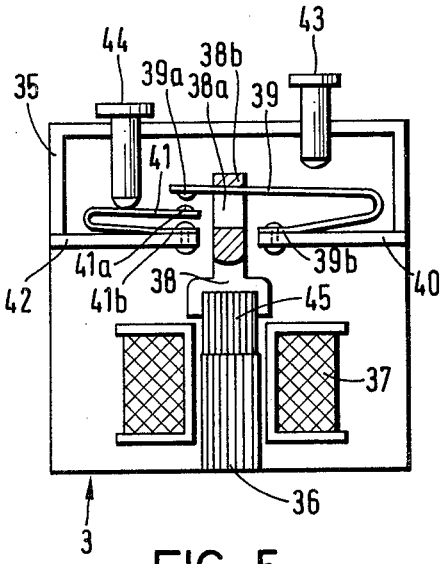
FIG. 5

FIG. 6
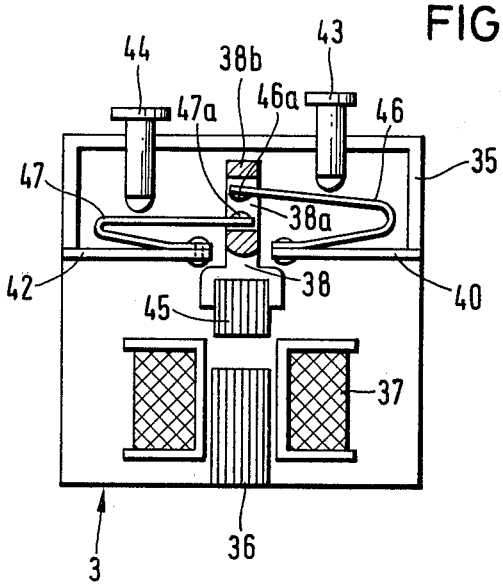
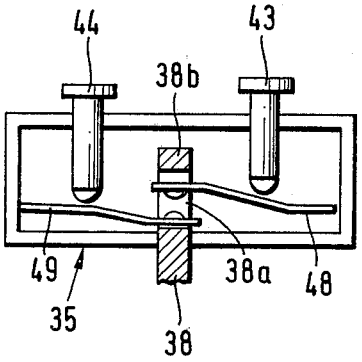
FIG. 7
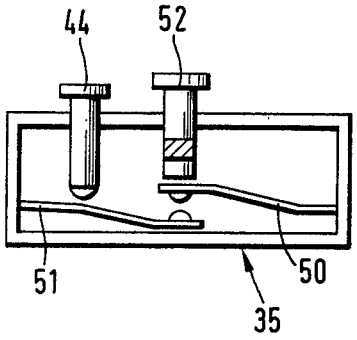
FIG. 8
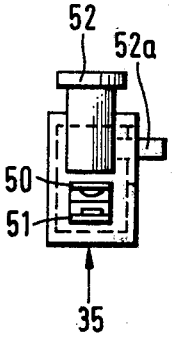
FIG. 9

SWITCH

The invention relates to a switch, relay or contactor. More particularly, it relates to a power, control or starter switch, relay or contactor having a contact system mounted in a housing and a magnetic system actuating the contact system, wherein the contact system is provided with contact bars having rigid contact blocks or pieces, as well as bridges having moveable contact pieces which are actuable by a common bridge support acting as opening and/or closing bridges, wherein each bridge with its associated contact bars is mounted in a switch chamber and wherein a switch-on contact is provided with a self-locking type contact. Switches, relays or contactors of this type may be used as individual switches, relays or contactors, as well as in a switch, relay or contactor combination.

Switches (as used herein, this term refers to switches, relays or contactors) of the aforementioned types are known in different forms. In these switches, a plunger is usually provided which can be actuated manually from the outside by means of a push key, thus operating a common bridge support which is displaced, so that when a certain voltage is applied to the switch, a certain switching operation is carried out with the provided opening and/or closing contacts. After releasing the push key, the switch moves back into its original position and the switching operation is concluded. In practical use, it is necessary to maintain a switching operation over a longer period of time, without requiring the constant manual depression of the key for the desired time period. For this purpose, a separate switch-on contact is provided and it had been suggested to use a closing contact of the switch for locking the switch. For switching off the switch, a further separate switching-off contact is provided.

In accordance with the state of the art, these two switch-on and switch-off contacts are each mounted in a separate switch housing, which are connected with the switch by means of electrical connecting wires. These separate device parts require an elaborate structure and a large space requirement and, in addition, necessitate a complicated and expensive wiring.

It is therefore an object of the invention to provide a switch wherein the structural and spatial requirements are considerably reduced and which permits a simple wiring.

This object of the invention is obtained in accordance with the invention by the provision of a contact yoke which is structurally integrated with the switch for the switch-on control and is actuable from the outside by means of an actuating element cooperating with the common bridge support. In this manner, the separate switch housing for the switch-on contact, which would have to be connected to the switch by means of electrical connection wiring is eliminated. Simultaneously, an important advantage is obtained in that the contact path of the integrated switch-on contact contains three functions—namely, the switching-on of the switch, the simultaneous self-locking of the switch with the same switch-on contact, and finally the usability of this switch-on contact with a corresponding switch arrangement for a normal closing like in any other normal closing contact of the switch.

In an advantageous embodiment of the invention, a further contact yoke is provided for the switch-off contact which is structurally integrated with the contact yoke of the switch-on contact and which is actuable from the outside by means of an actuating element. In this manner, the further separate switch housing for the switch-off contact, in accordance with the state of the art, is eliminated and the wiring is further simplified.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

In the drawings, wherein similar reference characters denote similar elements throughout the several views:

FIG. 2 is a vertical sectional view through a simplified switch, embodying the present invention, having an integrated switch chamber for switch-on and switch-off contacts which are shown in a rest or off position;

FIG. 3 is a sectional view comparable to that of FIG. 2, showing the switch-on contact being actuated;

FIG. 4 is a sectional view comparable to that of FIG. 2, showing the switch in a self-locking position caused by the actuation of the switch-on contact;

FIG. 5 is a sectional view comparable to that of FIG. 2, but at the moment of actuation of the actuating element for the switch-off contact;

FIG. 6 is a vertical sectional view of an alternate embodiment of the invention wherein the parts for the switch-on and switch-off contacts, as well as for the two actuating elements have a manufacturing-simplified symmetrical design and uniformity;

FIG. 7 is a sectional view through a switch chamber of a further embodiment of the invention wherein other structural but symmetrically arranged parts are provided for the contact yokes of the switch-on and switch-off contacts and actuating elements;

FIG. 8 is a sectional view through a switch chamber of another embodiment of the invention, wherein the switch-on contact together with the actuating element form an integrated structure with the plunger of the bridge support;

FIG. 9 is a cross-sectional view of FIG. 8;

Figure 1:
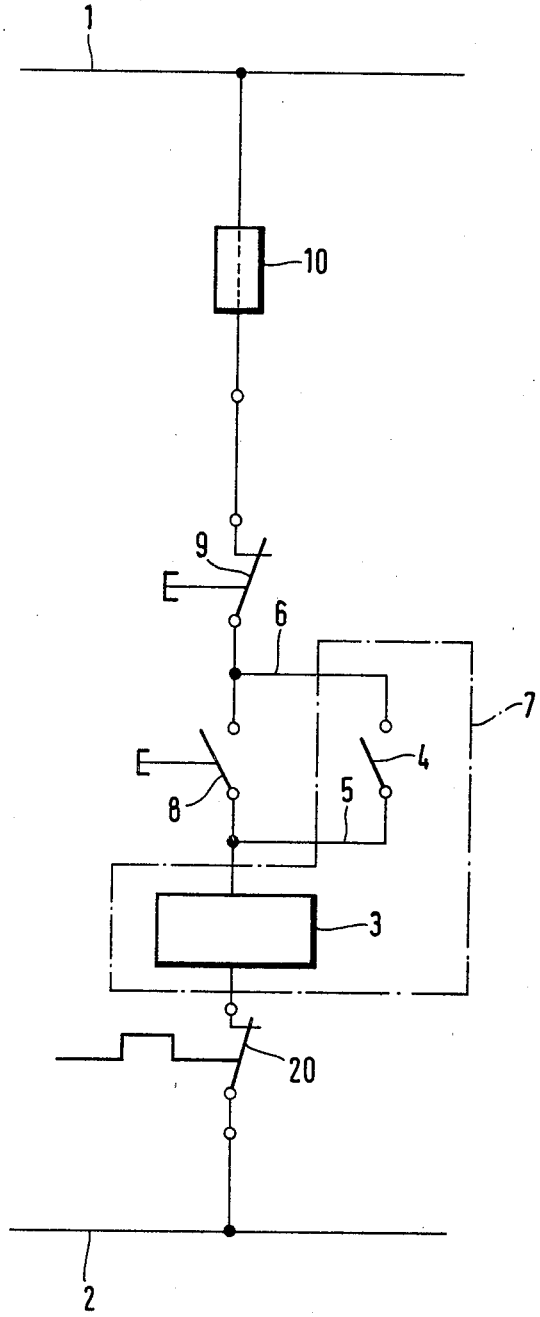
FIG. 1 is a circuit diagram for a switch, embodying the present invention.

Referring now in detail to the drawings, FIG. 1 shows a simplified circuit diagram for a switch, contactor or relay which is connected to an electrical circuit via lines 1 and 2. When the main or line switch 20 is closed, a switch, relay or contactor 3 can only operate when switch-on contact 8 is actuated. A further contact 4 is connected in parallel with switch-on contact 8 by means of lines 5, 6 which is designed as a contact for switch 3 and which also closes the circuit after the switch operates such, maintaining a closed circuit, even if switch-on contact 8 is again opened.

For switching off the switch, a switch-off contact 9 is provided which breaks the circuit and releases the contact. The reference numeral 10 designates a common fuse. As explained above, in accordance with the state of the art, the two contacts 8 and 9 are mounted in separate switch housings and operate as switch-on and switch-off contacts, respectively.

In accordance with the invention, a contact bridge piece or yoke of the switch-on contact is structurally integrated with the switch and is actuable from the outside by means of an actuating element. This yoke cooperates with a common bridge support to effect a self-locking of the switch-on contact. One embodiment of this basic concept of the invention is shown in FIGS. 2 to 5 in different switching positions.

In the illustrated simplified housing of switch 3, a magnet system consisting of a magnet core 36, a coil 37 and a magnet armature 45 are provided. A common bridge support 38 is connected with magnet armature 45, which will be discussed in greater detail hereinafter with respect to FIGS. 11 and 12.

A switch chamber 35 is provided in the upper part of the housing, wherein a contact bridge piece or yoke 39 for the switch-on contact is provided, as well as a contact bridge piece or yoke 41 for the switch-off contact. As can be seen in FIGS. 2–5, contact yoke 41 is provided in the same structural unit with contact yoke 39 of the switch-on contact. Therefore, in this embodiment, the contact yokes 39, 41 of the switch-on and switch-off contacts with the associated rigid contact bars 40 and 42 are mounted in the common switch chamber 35. In this embodiment, contact yokes 39, 41 are designed as U-shaped spring yokes which are mounted with one end **39*b* or 41*b* on the contact bars 40 or 42, respectively. At their other ends, spring yokes 39, 41 support overlapping movable contact ends or studs 39*a* or 41*a*, respectively. The spring yoke 39 of the switch-on contact extends through an opening 38a of bridge support 38**.

Contact yoke 39 is actuable by an actuating element or push key 43, while for the actuation of contact yoke 41 of the switch-off contact, a further actuating element or push key 44 is provided.

The operation of the aforementioned switch, relay or contactor is essentially as follows: In the rest or off position, contact yokes 39, 41 of the switch-on and switch-off contacts and actuating elements or push keys 43, 44 are in the position shown in FIG. 2, whereby the movable contact studs **39*a* and 41*a* are disposed at a distance from each other. When actuating actuating element 43 from the outside, the free shank of U-shaped spring yoke 39 of the switch-on contact is moved downwardly, so that contact piece 39*a* comes into engagement with contact stud 41*a*, as shown in FIG. 3. Thereby, the switch-on contact is switched on. By switching on the switch, armature 45 together with common bridge support 38 is pulled downwardly, so that the arm 38*b* engages the free shank of spring yoke 39 of the switch-on contact. Thereby, the switch is locked in an on position, thereby maintaining a closed circuit. This switch position is shown in FIG. 4. The switching-off of the switch, relay or contactor is carried out by means of the actuating element 44 which deflects the free shank of the spring yoke 41 of the switch-off contact downwardly, so that the movable contact stud 41*a* is depressed and disengaged from contact stud 39*a*. By means of a spring force, armature 45 together with the bridge support 38 is brought back from the switch position of FIG. 5 to the initial position shown in FIG. 2**.

Figure 11:
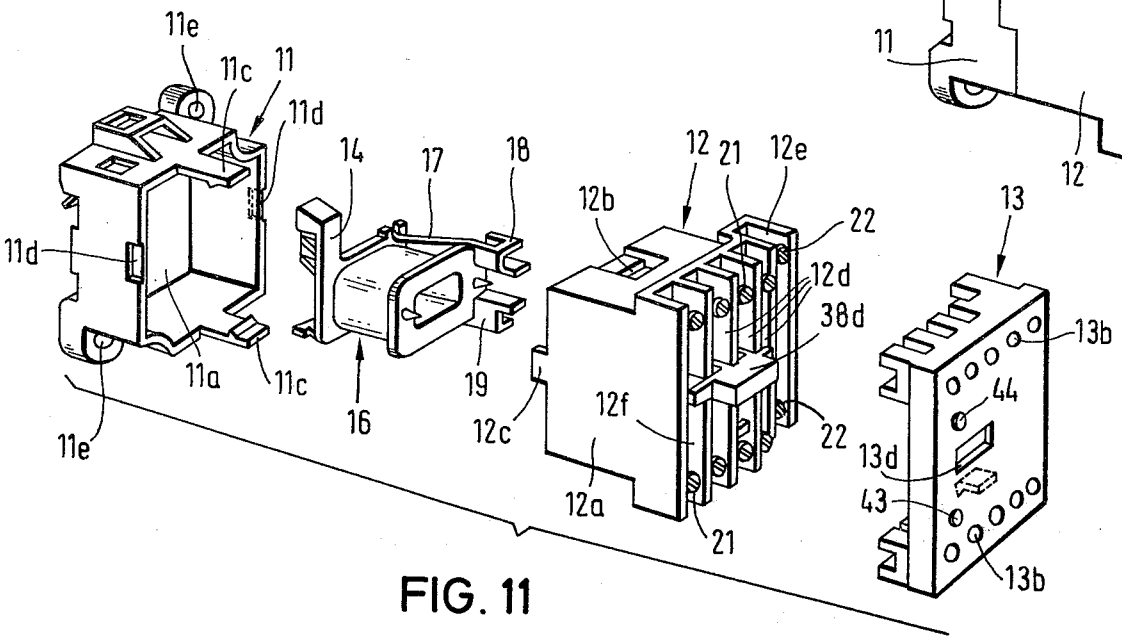
FIG. 11 is an exploded, perspective view of the individual parts of the switch shown in FIG. 10, with the magnet armature and the magnet core being omitted.
Figure 12:
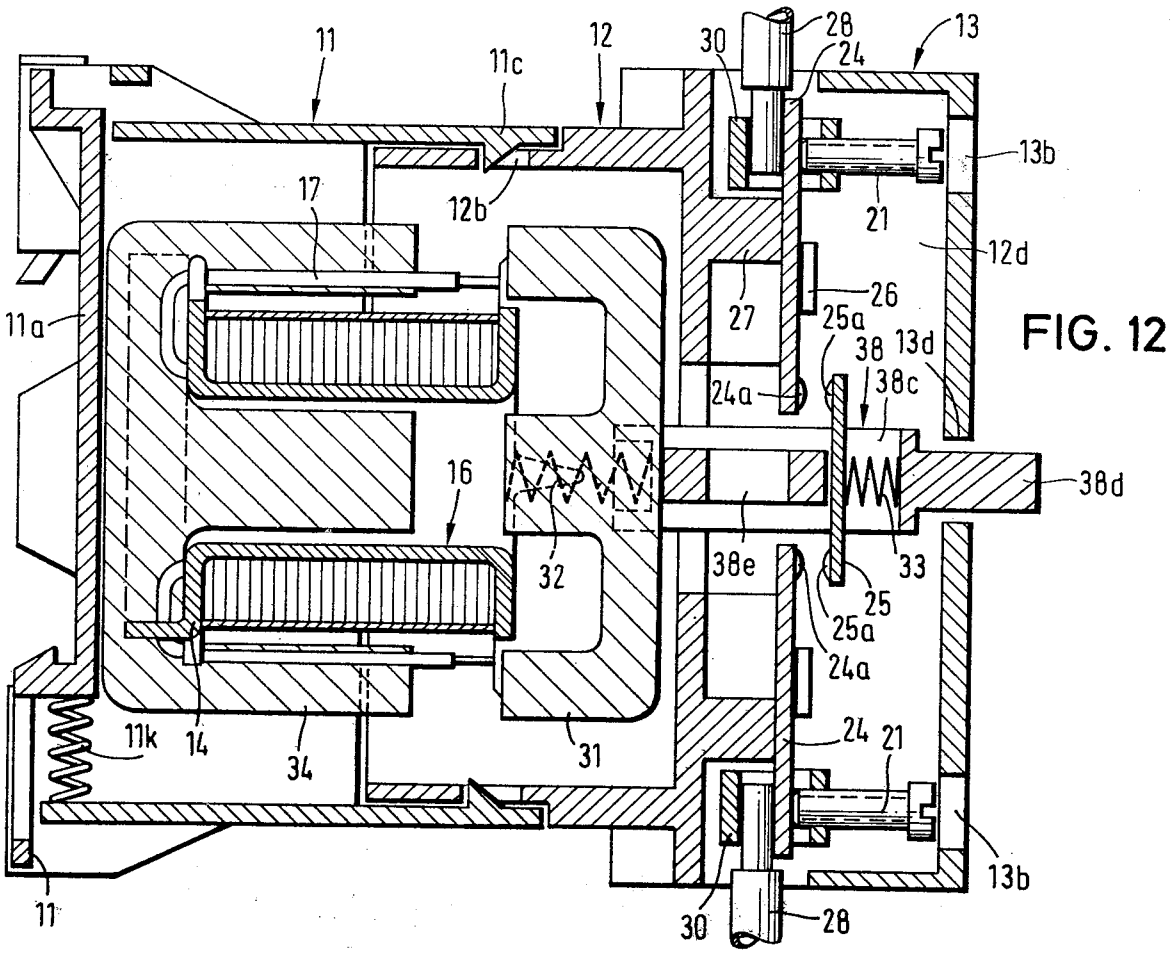
FIG. 12 is a longitudinal sectional view of the switch taken along line 12—12 of FIG. 10.

The aforementioned construction essentially provides four functions—namely, the switching on, the self-locking of the switch, the switching-off and, in addition, the integrated contact device may be used for a normal closing, like the following described bridge or closing contacts in conjunction with FIGS. 11 and 12. It is to be understood that in the latter case, the actuating elements 43 and 44 are not actuated. A further advantage of the embodiment in accordance with FIGS. 2 to 5 is that the switch chamber 35 mounted in the switch housing corresponds to the remainder of the switch chambers **12*d* (FIG. 11**) which permits a considerable simplification during manufacturing.

FIG. 6 illustrates another embodiment of a switch which is constructed in a similar manner to the one shown in FIGS. 2 to 5. However, in this embodiment, the U-shaped spring yokes 46, 47 of the switch-on contact and the switch-off contacts, are completely alike or symmetrical, which is also true for the rigid contact bars 40, 42. The two spring yokes are only different in that they have different angles of deflection in the rest position, as can be seen in FIG. 6. This different angle of deflection is carried out during the preassembly operation. However, for manufacturing purposes, it should be noted that it is advantageous that the spring yokes and the contact bars have equal lengths. In this case, the movable contact pieces **46*a* and 47*a* overlap in the area of opening 38*a* of bridge support 38. The operation of this switch corresponds to the switch of FIGS. 2 to 5**.

In another embodiment, in accordance with FIG. 7, the contact yokes 48, 49 of the switch-on and switch-off contacts with their movable contact studs are basically designed as flat spring yokes, which are mounted at one end. The movable contact studs on the other end overlap advantageously in the area of opening **38*a* of bridge support 38**. In this embodiment, the spring yokes are of equal dimension and are arranged in a symmetric manner, which again simplifies the manufacturing operation.

A further embodiment in accordance with FIG. 8 corresponds basically to the embodiment of FIG. 7, in that the contact yokes 50, 51 of the switch-on and switch-off contacts are basically shaped as flat spring yokes mounted in switch chamber 35. In this case, a further simplification is achieved in that the actuating element 52 of the switch-on contact is designed as an integral structural unit with the outside-actuated plunger of the bridge support. Thereby, a further separate actuating element or a push key for the switch-on contact is eliminated. Switch chamber 35 of this embodiment, in accordance with FIGS. 8 and 9, is suitable, in particular, as a special chamber, i.e., this switch chamber may be manufactured at first as a separate chamber and can then be optionally mounted on the switch housing or laterally thereof. In a directly integrated lateral disposition of the switch chamber on the housing, a connecting rib **52*a* is provided leading to the common bridge support 38 of the switch, so that again all functions, i.e., switching on, switching off of contacts 50, 51**, self-locking of the switch and usability as a normal closing contact are assured. When mounting the switch chamber on the housing of the switch, the connecting rib leading to the bridge support may be designed differently.

Figure 10:
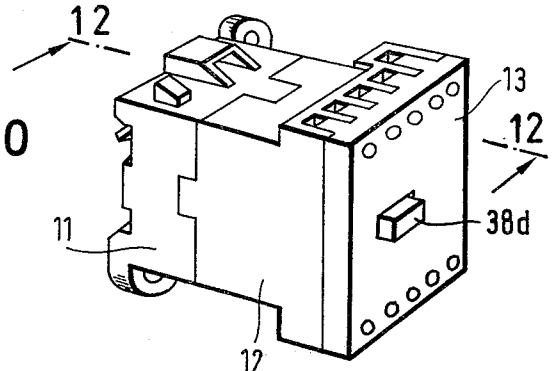
FIG. 10 is a perspective view of a switch embodying the present invention.

For a better understanding of the total structure of a switch, a further embodiment is shown and described in conjunction with FIGS. 10, 11 and 12. The housing of the switch consists of a plurality of housing parts 11, 12 and 13 which are made of a rugged or tough plastic. Housing part 11, together with a base plate 11*a*, is mounted on a mounting plane, for example, a circuit board or in a circuit box. Housing 11 is provided with lateral projections 11*e* having associated bores which may be used for mounting the same. Alternatively, a latch 11h which is under the influence of a compression spring 11*k* (FIG. 12) may be provided which, together with a counter abutment, engages a profiled bar (not shown) of the circuit board or the circuit box.

On the inside of housing part 11, the magnet system is mounted which consists of a coil 16 with connecting lines 17 and connecting pieces 18, 19, a magnet core 34 and a movable armature 31. The mounting of coil 16 and the magnet core may be achieved with the assistance of a mounting means 14 which is inserted in a clamping position.

On the upper and the lower sides of housing portion 11, resilient flanges or lugs 11*c* are provided which cooperate with corresponding recesses and arresting means 12*b* of housing part 12. Lug-like projections 12*c* are also provided on the two side faces of housing portion 12 which engage in corresponding recesses with arresting means 11*d* of housing part 11. Thereby, by means of a manual sliding together, the two housing parts 11 and 12 may be tightly coupled to one another.

Housing part 12 does not contain a contact system. For this purpose, four adjacent switch chambers 12*d* arranged parallel to each other are provided between the two side faces 12*a*. One of these switch chambers, preferably the one shown in FIG. 11 close to the front edge, i.e., switch chamber 12*f*, is designed in a manner corresponding to the above-described switch chamber 35. The switch chambers as such are basically designed as U-shaped troughs with open front faces. Thereby, the U-shaped troughs are open in a direction away from the mounting plane. Two contact bars 24 with rigid contact studs or pieces 24*a* are provided in switch chambers 12*d* and are inserted between guides 26, 27 of housing part 12, as well as into a generally rectangular frame 30. Contact bars 24 are held in position by contact connecting screws 21 which simultaneously hold the electrical connecting lines 28 in position. A bridge 25 with movable contact studs 25*a* cooperates with the two contact bars 24 in switch chambers 12*d*. In the shown embodiment, a switch is illustrated which can be converted into an opening element by turning the two contact bars of the corresponding switch chamber by 180°, so that the contact faces 24*a* face toward the mounting plane. Furthermore, bridge 25 together with the contact spring 33 would be removed from opening 38*c* of the bridge support 38, which is common for all bridges, and would be reinserted into opening 38*e* after being turned by 180°.

Common bridge support 38 essentially consists of a plate, one end of which is connected with the armature 31 of the magnet system. Furthermore, compression springs 32 are provided which in the switched-off position of coil 16 pushes the armature 31 and the common bridge support back into the shown rest position. At its end facing away from the mounting plane, bridge support 38 is provided with a projection 38*d* which extends through an opening 18*d* of housing part 13 which serves as a lid. Housing part 13 covers the contact system in housing part 12. In this housing part, two rows of holes 13*b* are provided through which a screwdriver may be inserted which is simultaneously guided by the corresponding wall of the aperture, thus enabling a free access to the contact connecting screws 21 and 22 for mounting the same.

In addition to the previously-described switch chambers 12*d* and 12*f* of housing part 12, a further troughlike space 12*e* is provided between the side walls 12*a* wherein the two connecting screws 22 for the coil of the magnet system are mounted. The housing part 13 can be mounted on housing part 12 by either sliding or clamping it thereon.

Figure 13:
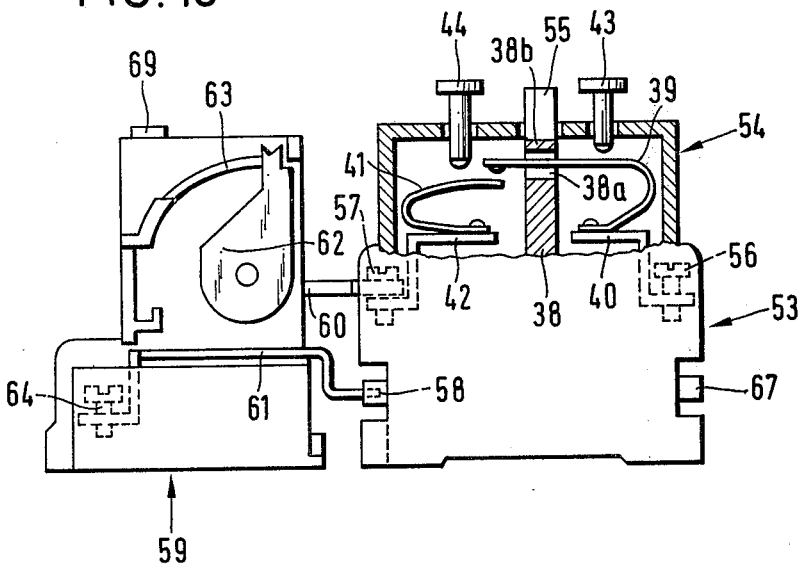
FIG. 13 is a side view of a switch embodying the present invention, with the switch chamber of the switch-on and switch-off contact shown in section, and which is provided with a motor protection switch mounted in front thereof.
Figure 14:
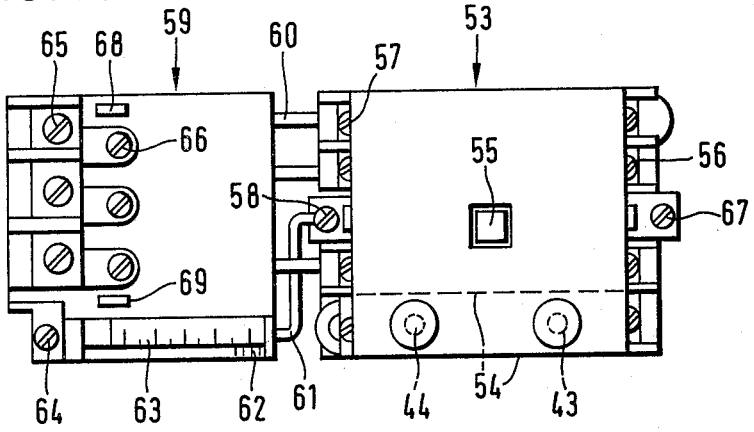
FIG. 14 is a plan view of the switch shown in FIG. 13.

A further embodiment of the invention is shown in FIGS. 13 and 14. A switch, relay or contactor 53 includes contact connecting screws 56, 57 and further contact connecting screws 58 and 67 for the coil, as well as an integrated switch chamber 54 which essentially corresponds to the embodiment shown in accordance with FIGS. 2 to 5. Common bridge support 38 is provided with an extension 55 which extends outwardly from the housing and may be used as a push key. Furthermore, actuating elements 43, 44 are provided. A motor protection device 59 is connected in front of switch 53 and is coupled to switch 53 by means of electrical lines 60 and 61. The motor protection device is provided with an adjustment lever 62 disposed opposite to a scale 63, whereby the trigger or trip sensitivity of this device can be adjusted. This motor protection device is provided with contact connecting screws 64, 65 and 66. In addition, push keys 68 and 69 are provided, whereby the push key 68 may also be used as the switch-off key, since it acts on the switch-off contact. Therefore, in this embodiment of the combined device, the actuating element 44 or the push key 68 may be selectively actuated for switching off the device. If need be, the actuating element 44 may be eliminated.

Figure 15:
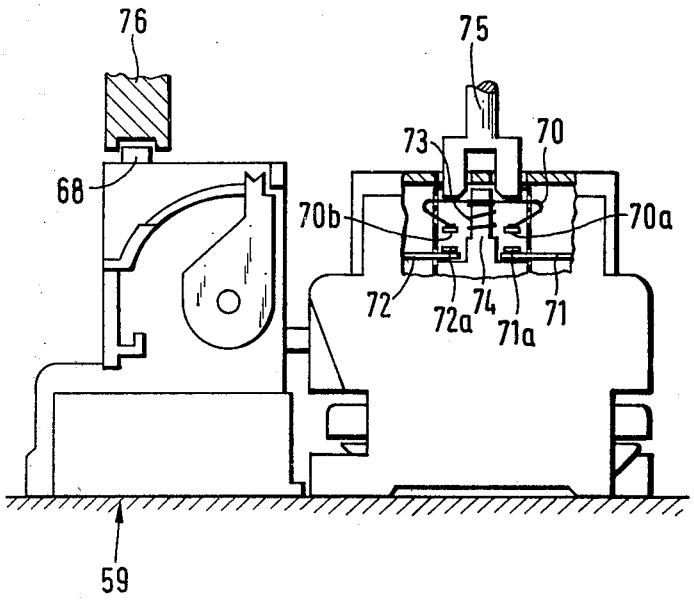
FIG. 15 is a side view of another embodiment of the switch comparable to that of FIG. 13, also provided with a motor protection switch.

FIG. 15 illustrates a further embodiment which essentially corresponds to the embodiment of FIG. 13, except that the movable contact 70 of the switch-on contact is a C-shaped spring yoke with two resiliently movable contact pieces 70*a*, 70*b*. These contact pieces cooperate with rigid or stationary contact pieces 71*a*, 72*b* of contact bars 71, 72. The C-shaped spring yoke 70 is held at its center in an opening of the actuating element 74 or the common bridge support by means of a compression spring 73. By means of a fork-like plunger 75, the C-shaped spring yoke 70 can be pushed in the direction of stationary contact bars 71, 72, so as to carry out the switching-on operation. The switching-off operation may be carried out in accordance with the embodiment of FIGS. 13 and 14 by means of a plunger 76 and a push key 68 of the motor protection switch 59.

Thus, while only several embodiments of the present invention have been shown and described, it will be obvious that many changes and modifications may be made thereunto, without departing from the spirit and scope of the invention.

What is claimed is:

1. In a switch used as a power, control or starter switch of the type including a housing, a contact system mounting in the housing and a magnetic system mounting in the housing for actuating the contact system, wherein the contact system is provided with contact bars having stationary contact pieces as well as bridges having movable contact pieces which act as opening or closing contacts and which are actuated by a common bridge support, with each bridge with its associated contact bar being mounted in a switch chamber and wherein a switch-on contact is provided with a self-locking type contact, the improvement comprising:

a contact yoke for said switch-on contact which is structurally integrated with the switch; and an externally-operated actuating element for actuating said contact yoke which cooperates with said common bridge support.

2. The switch according to claim 1, additionally including a further contact yoke for the switch-off contact which is structurally integrated with said contact yoke for said switch-on contact, and an externally-operated actuating element for actuating said contact yoke of the switch-off contact.

3. The switch according to claim 2, wherein said contact yokes of said switch-on and switch-off contacts together with their associated contact bars are mounted in a common switch chamber.

4. The switch according to claim 3, wherein there is a plurality of switch chambers which are mounted in said switch housing.

5. The switch according to claim 3, wherein said switch chamber is mounted on said housing.

6. The switch according to claim 3, wherein said switch chamber is mounted laterally of said housing, and wherein a connecting rib is provided for connecting to said bridge support.

7. The switch according to claim 1, wherein an externally-actuated plunger is provided for said bridge support and wherein said actuating element of said switch-on contact is designed in one structural unit with said externally-actuated plunger of said bridge support.

8. The switch according to claim 2, wherein said contact yokes comprise U-shaped spring yokes which are each mounted at one end on the associated contact bar and which support movable contact pieces on their other ends which overlap one another.

9. The switch according to claim 8, wherein said spring yoke of said switch-on contact engages into an opening of said bridge support.

10. The switch according to claim 2, wherein said contact yokes comprise flat spring yokes which are supported at one free end and which support with their other free end the movable contact pieces which overlap with one another in the zone of an opening of said bridge support.

11. The switch according to claim 1, wherein said contact yoke of the switch-on contact is designed as a C-shaped spring yoke, having two yoke ends each of which are provided with a yieldable and movable contact piece, and wherein said spring yoke is maintained in one opening of the actuating element or the bridge support by means of a compression spring.

* * * * *